US008727914B2

(12) United States Patent
Sells

(10) Patent No.: US 8,727,914 B2
(45) Date of Patent: May 20, 2014

(54) BASEBALL TRAINING APPARATUS

(76) Inventor: Glynon T. Sells, St. Clair Shores, MI (US)

( * ) Notice: Subject to any disclaimer, the term of this patent is extended or adjusted under 35 U.S.C. 154(b) by 196 days.

(21) Appl. No.: 13/173,260

(22) Filed: Jun. 30, 2011

(65) Prior Publication Data

US 2012/0010029 A1 Jan. 12, 2012

Related U.S. Application Data

(60) Provisional application No. 61/362,331, filed on Jul. 8, 2010.

(51) Int. Cl.
*A63B 69/00* (2006.01)

(52) U.S. Cl.
USPC ..... 473/458; 224/607; 206/315.1

(58) Field of Classification Search
USPC ..... 473/458; 2/161.1, 304, 161.2; 24/442, 24/306; 84/468; 206/460; 280/814
See application file for complete search history.

(56) References Cited

U.S. PATENT DOCUMENTS

| | | | | | |
|---|---|---|---|---|---|
| 702,398 | A * | 6/1902 | Bowyer | 224/250 |
| 3,297,026 | A * | 1/1967 | Van Pelt | 128/878 |
| 3,888,482 | A * | 6/1975 | Starrett et al. | 473/458 |
| 3,947,927 | A * | 4/1976 | Rosenthal | 24/306 |
| 4,420,104 | A * | 12/1983 | Dilenno | 224/250 |
| 4,638,764 | A * | 1/1987 | Anderson | 119/770 |
| 4,759,963 | A * | 7/1988 | Uso et al. | 428/100 |
| 4,856,149 | A * | 8/1989 | Brame | 24/3.2 |
| 4,862,563 | A * | 9/1989 | Flynn | 24/442 |
| 4,960,280 | A * | 10/1990 | Corder, Jr. | 473/212 |
| 5,076,288 | A * | 12/1991 | Millard et al. | 128/869 |
| 5,081,714 | A * | 1/1992 | Liu | 2/418 |
| D357,801 | S * | 5/1995 | Short | D3/215 |
| 5,582,337 | A * | 12/1996 | McPherson et al. | 224/660 |
| D377,862 | S * | 2/1997 | Moore | D3/228 |
| 5,672,127 | A * | 9/1997 | Danz | 473/458 |
| D386,829 | S * | 11/1997 | Lovin | D29/122 |
| 6,138,882 | A * | 10/2000 | Buettner | 224/250 |
| 6,773,366 | B2 * | 8/2004 | Gray | 473/458 |
| 2012/0010029 | A1 * | 1/2012 | Sells | 473/458 |

* cited by examiner

*Primary Examiner* — Gene Kim
*Assistant Examiner* — M Chambers
(74) *Attorney, Agent, or Firm* — Fildes & Outland, P.C.

(57) ABSTRACT

A baseball training apparatus includes a bat mounting portion mountable on a barrel of a baseball bat, and a glove mounting portion attachable to a baseball glove. The glove mounting portion is connected to the bat mounting portion. The bat mounting portion may include an elongated, flexible, mounting strap including a hook-and-loop fastener. The glove mounting portion may include at least one elongated, flexible connector strap extending outwardly from opposite edges of the mounting strap and including a hook-and-loop fastener. The baseball training apparatus mounts the baseball glove on the baseball bat.

17 Claims, 2 Drawing Sheets

BASEBALL TRAINING APPARATUS

CROSS REFERENCE TO RELATED APPLICATION

This application claims the priority of U.S. Provisional Application No. 61/362,331 filed Jul. 8, 2010.

TECHNICAL FIELD

This invention relates to a baseball training apparatus, and more particularly to a training apparatus for practicing bunting skills.

BACKGROUND OF THE INVENTION

In order to properly bunt a baseball with a bat, it is necessary to refrain from moving the bat in a forward motion towards the pitched ball and instead to pull the bat in a backward motion away from the pitched ball. A batter should refrain from lunging the bat at the baseball. When bunting, a forward bat motion undesirably can cause the batter to pop the ball up in the air, while a backward/non-forward bat motion desirably causes the ball to be hit on the ground. Mastering proper bunting technique requires practice, and thus a need exists for a training apparatus that helps baseball players enhance their bunting skills.

SUMMARY OF THE INVENTION

The present invention provides a baseball training apparatus that allows a player to easily and securely mount a catching glove on a bat for practicing proper bunting technique.

More particularly, a baseball training apparatus in accordance with the present invention includes a bat mounting portion mountable on a barrel of a baseball bat, and a glove mounting portion attachable to a baseball glove. The glove mounting portion is connected to the bat mounting portion. The baseball training apparatus mounts the baseball glove on the baseball bat.

The bat mounting portion may include a hook-and-loop fastener. The glove mounting portion may include a hook-and-loop fastener. The bat mounting portion and the glove mounting portion may be separate members that are attached together. Alternatively, the bat mounting portion and the glove mounting portion may be integrally formed of a single member.

In one embodiment, a baseball training apparatus in accordance with the present invention includes an elongated, flexible, mounting strap wrappable around a barrel of a baseball bat. At least one elongated, flexible connector strap extends outwardly from opposite edges of the mounting strap. The connector strap is wrappable around a rear portion of a baseball glove.

Each connector strap may be disposed generally perpendicular to the main strap. Each connector strap may extend across the main strap. The baseball training apparatus may include two connector straps, which may be generally equidistant from a center of the mounting strap.

The mounting strap may include a hook-and-loop fastener and may have opposite first and second sides. The mounting strap first side may include loops of the hook-and-loop fastener and the mounting strap second side may include hooks of the hook-and-loop fastener. Each connector strap may include a hook-and-loop fastener and may have opposite first and second sides. The connector strap first side may include loops of the hook-and-loop fastener and the connector strap second side may include hooks of the hook-and-loop fastener. The mounting strap first side may face the same direction as each connector strap first side, and the mounting strap second side may face the same direction as each connector strap second side.

Each connector strap may be shorter and/or smaller than the mounting strap. The mounting strap and each connector strap may be separate members that are attached together. Alternatively, the mounting strap and each connector strap may be portions of an integrally formed single member.

A method of mounting a baseball glove to a baseball bat in accordance with the present invention includes the steps of: strapping a mounting strap of an apparatus to a barrel of a baseball bat; inserting a handle end of a baseball bat between a wrist strap of a baseball glove; sliding the baseball glove up the barrel of the baseball bat with a pocket of the baseball glove facing away from the baseball bat; aligning the baseball glove with the apparatus; and strapping connector straps of the apparatus to the wrist strap of the baseball glove to secure the baseball glove to the baseball bat.

These and other features and advantages of the invention will be more fully understood from the following detailed description of the invention taken together with the accompanying drawings.

DETAILED DESCRIPTION OF THE INVENTION

Figure 1:
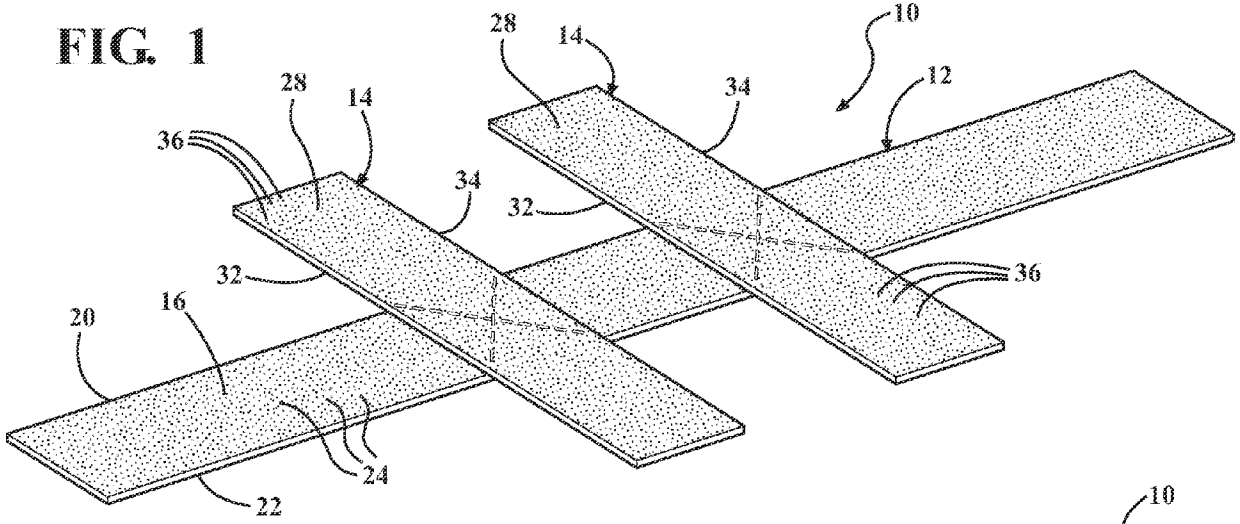
FIG. 1 is a perspective view of a first side of a baseball training apparatus in accordance with the present invention.

Referring now to the drawings in detail, numeral 10 generally indicates a baseball training apparatus in accordance with the present invention. The baseball training apparatus 10 is mountable on a barrel of a baseball bat and secures a baseball glove to the barrel of the bat with the pocket of the glove facing away from the bat. Once the baseball glove is securely mounted on the barrel of the bat, a person can practice proper bunting technique by catching/receiving pitched balls in the pocket of the glove while holding the bat.

Figure 2:
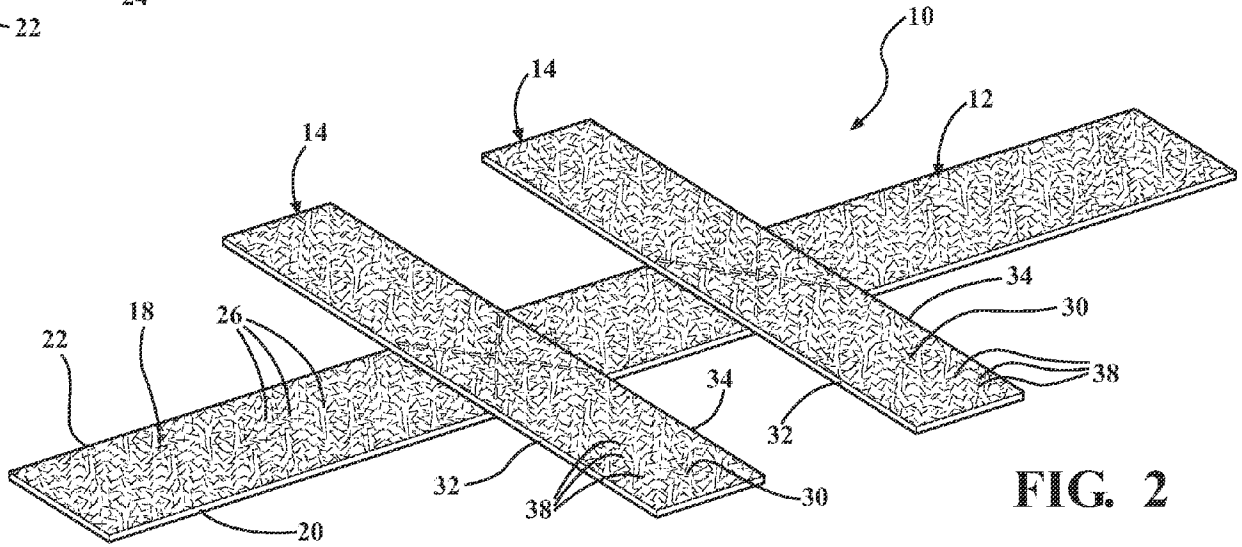
FIG. 2 is a perspective view of an opposite, second side of the baseball training apparatus.

As shown in FIGS. 1 and 2, the baseball training apparatus 10 generally includes a bat mounting portion which in one embodiment may be defined by an elongated, flexible mounting strap 12 and a glove mounting portion which in one embodiment may be defined by at least one elongated, flexible connector strap 14 that is attached to the mounting strap. In the embodiment shown in the drawings, the apparatus 10 includes two connector straps 14 that are spacedly disposed from each other and that are each separately attached to the mounting strap 12. The bat mounting portion is mountable on a barrel of a baseball bat, and the glove mounting portion is attachable to a baseball glove.

The mounting strap 12 may be generally rectangular in shape having a length that is much greater than its width. For example, the length of the mounting strap may be approximately six times the width. However, it should be understood that the mounting strap 12 does not have to be rectangular (e.g., it can be trapezoidal, it can have pointed ends, etc.) and can have any specific shape, as long as the mounting strap has sufficient length to be able to be wrapped around a barrel of a baseball bat. In other words, the length of the mounting strap 12 should be greater than the circumference of the barrel of a baseball bat. The mounting strap 12 has a first side 16, an opposite second side 18, and opposite edges 20, 22 along the length direction of the strap. The mounting strap 12 may include a fabric hook-and-loop fastener such as Velcro or similar having loops 24 and cooperable hooks 26. The surface of the mounting strap first side 16 includes the loops 24 of the hook-and-loop fastener and the surface of the mounting strap second side 18 includes the hooks 26 of the hook-and-loop fastener.

Each connector strap 14 may be generally rectangular in shape having a length that is much greater than its width. For example, the length of each connector strap may be approximately seven times the width. However, it should be understood that each connector strap 12 does not have to be rectangular (e.g., it can be trapezoidal, it can have pointed ends, etc.) and can have any specific shape, as long as each connector strap has sufficient length to be able to be wrapped around a rear portion of a catching glove such as the wrist strap (wristband) of a baseball glove. Also, each connector strap 14 may be smaller than and/or shorter than the mounting strap 12. Each connector strap 14 has a first side 28 and an opposite second side 30, and opposite edges 32, 34 along the length direction of the strap. Each connector strap 14 may include a fabric hook-and-loop fastener such as Velcro or similar having loops 36 and cooperable hooks 38. The surface of the connector strap first side 28 includes the loops 36 of the hook-and-loop fastener and the surface of the connector strap second side 30 includes the hooks 38 of the hook-and-loop fastener.

The mounting strap first side 16 corresponds to each connector strap first side 28 and therefore the sides 16, 28 face the same direction. Likewise, the mounting strap second side 18 corresponds to each connector strap second side 30 and therefore the sides 18, 30 face the same direction. Thus, the loops 24, 36 of the straps 12, 14 face the same direction, and the hooks 26, 38 of the straps 12, 14 also face the same direction which is opposite to the direction the loops 24, 36 face.

Each connector strap 14 extends outwardly from the opposite edges 20, 22 of the mounting strap 12. For example, in the embodiment shown in the drawings, each connector strap 14 extends across the width direction of the mounting strap 12 such that the connector strap and mounting strap are disposed in a generally transverse relationship (i.e., the connector strap is perpendicular to the mounting strap). Thus, the edges 20, 22 of the mounting strap 12 are generally at right angles to the edges 32, 34 of each connector strap 14. In this embodiment, the mounting strap 12 and each connector strap 14 are separate members that are securely fixed/attached together. For example, each connector strap 14 may be sewn/stitched to the mounting strap 12. Alternatively or additionally, each connector strap may be adhered to the mounting strap 12 by a suitable adhesive or similar. Also, the adjacent hooks and loops of the mounting strap 12 and connector strap 14 fasten the connector strap to the mounting strap, thereby enhancing the attachment of the straps to each other.

In an alternative embodiment, the mounting strap 12 and each connector strap 14 may be may be an integrally formed single member. For example, the apparatus 10 may be formed by cutting a single piece of material.

The apparatus 10 generally may have a cross shape, a lower case "t" shape, and/or a plus-sign shape. For example, the connector straps 14 may be approximately equidistant from a center of the mounting strap 12 such that the apparatus 10 has a generally symmetrical shape. However, the connector straps 14 do not necessarily have to be disposed about the center of the mounting strap 12 and may alternatively be disposed towards one end of the mounting strap. Also, the connector straps 14 do not have to be perpendicular to the mounting strap 12. For example, each connector straps 14 may be disposed at a 45 degree angle relative to the length direction of the mounting strap such that the connector straps cross each other to form and X-shape.

While the apparatus 10 has been described as being formed of a fabric hook-and-loop fastener material such as Velcro, it should be understood that the invention is not limited to this construction. The invention is not limited to any particular material, as long as the bat mounting portion is capable of being strapped or otherwise mounted on a barrel of a baseball bat and the glove mounting portion is capable of strapping or otherwise securing a baseball glove. For example, the bat mounting portion may be a strap formed of a silicon rubber or other similar elastomeric material. The glove mounting portion may be formed of ties rather than straps. Also, the bat mounting portion and/or glove mounting portion may include straps that are fastened/secured by a fastener other than a hook-and-loop fastener.

Figure 3:
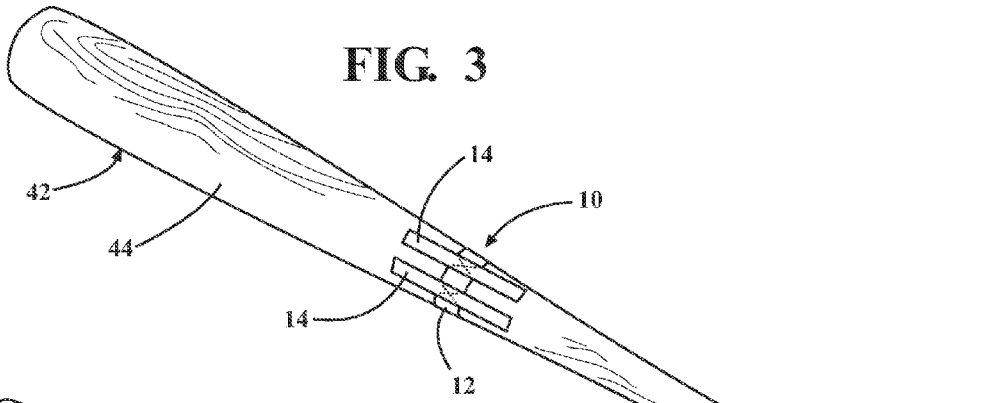
FIG. 3 is an environmental view of the baseball training apparatus mounted on a baseball bat.

With reference now to FIGS. 1 through 5, to mount a baseball glove 40 to a baseball bat 42, the mounting strap 12 is strapped to the bat by wrapping the mounting strap around the circumference of the barrel 44 of the bat so that the connector straps 14 are aligned with and generally parallel to the longitudinal axis of the bat, i.e., the connector straps point up and down the barrel of the bat as shown in FIG. 3. The mounting strap 12 is secured by pressing the second side 18 of the mounting strap against the first side 16 to engage the hooks 26 and loops 24, and then sliding/forcing the wrapped mounting strap up the barrel 44 of the bat 42 until the mounting strap is snugly pressed against the barrel and cannot move further up the barrel. Preferably, the second side 18 including the hooks 26 faces the bat barrel 44. The hook-including second side 18 provides a gripping surface that resists slipping of the strap along both axial and radial directions of the bat barrel 44.

Figure 4:
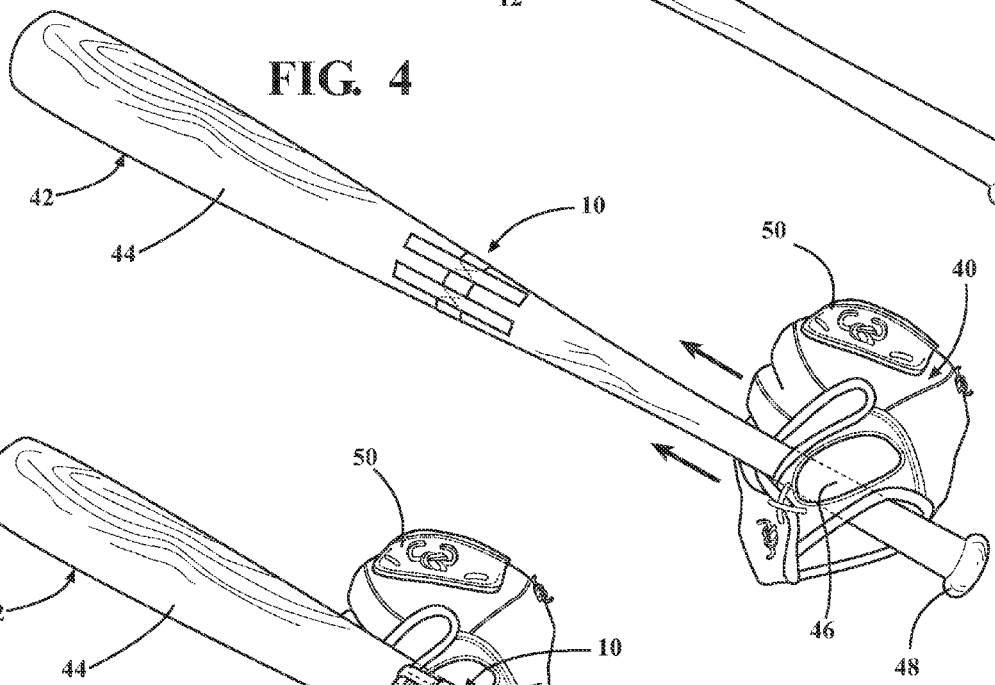
FIG. 4 is an environmental view illustrating sliding of a baseball glove up the barrel of the baseball bat on which the baseball training apparatus is mounted.
Figure 5:
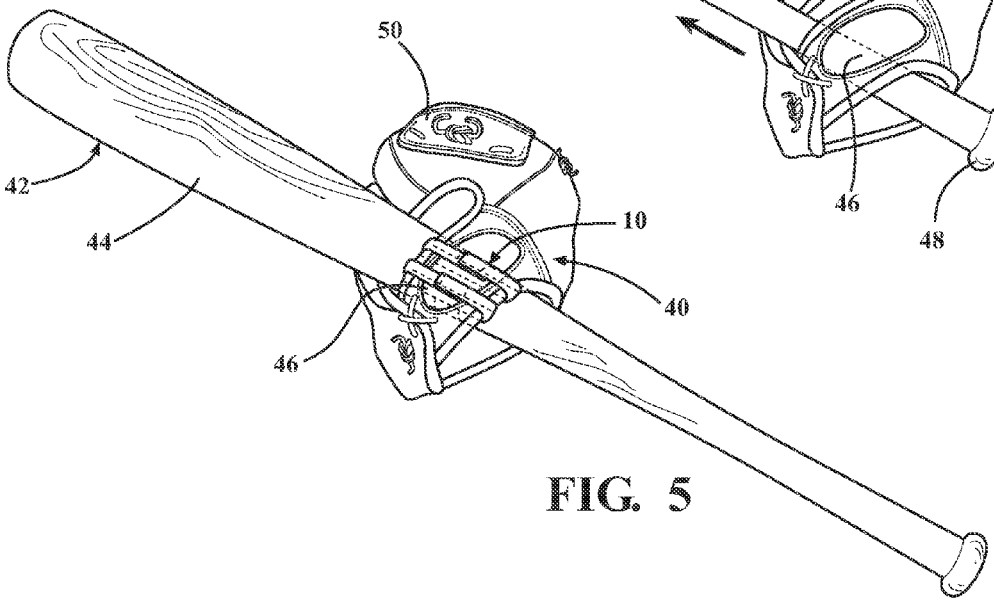
FIG. 5 is an environmental view of the baseball glove secured to the barrel of the baseball bat by the baseball training apparatus.

Once the mounting strap 12 is mounted on the bat 42, the wrist strap 46 of the glove 40 is slipped over the knob at the handle end 48 of the bat so that the handle of the bat is between the wrist strap of the glove. The glove 40 is then slid up the barrel 44 of the bat 42 with the pocket 50 of the glove facing away from the bat as shown in FIG. 4. The glove 40 is aligned with the apparatus 10 such that the wrist strap 46 of the glove is generally positioned over the mounting strap 12. Each connector strap 14 is then strapped to the glove 40 by wrapping the connector strap around the wrist strap 46 of the glove and pressing the first side 28 of the connector strap against the second side 30 to engage the hooks 38 and loops 36. In this disposition, the glove 40 is securely mounted on the bat 42 with the pocket 50 of the glove facing outward as shown in FIG. 5.

The baseball training apparatus 10 allows a user to keep his/her hands and fingers in a proper bunting grip position on the bat 42 while being able to catch/receive a pitched ball in the pocket 50 of the glove 40. The user does not have to use his/her hands to hold or manipulate the glove 40 during bunting skill practice. The pocket 50 of the glove is generally positioned in a location along the barrel 44 of the bat 42 where a hitter would contact a ball with the bat to bunt the ball.

Further, to catch a ball in the mounted glove 40, the user must move the barrel 44 of the bat 42 backwards, which simulates proper bunting technique.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A baseball training apparatus for securely mounting a baseball glove on a baseball bat, said apparatus comprising:

a bat mounting portion mountable on a barrel of the baseball bat; and a glove mounting portion attachable to the baseball glove, the glove mounting portion being connected to the bat mounting portion;

said bat mounting portion including a single elongated, flexible mounting strap having first and second opposite, free ends, and a fastener at each of the first and second ends that releasably connects the first and second ends to form an adjustable loop;

said glove mounting portion including two transverse elongated, flexible connector straps, each connector strap having first and second opposite, free ends, and a fastener at each of the first and second ends that releasably connects the first and second ends to form an adjustable loop;

said connector straps being spacedly disposed and separately attached to said mounting strap such that said connector straps are generally equidistant from a center of said mounting strap, and each connector strap extending perpendicular to said mounting strap from opposite edges of said mounting strap;

whereby the baseball training apparatus mounts the baseball glove on the baseball bat.

2. The baseball training apparatus of claim 1, wherein the fastener of the bat mounting portion is a hook-and-loop fastener.

3. The baseball training apparatus of claim 1, wherein the fastener of the glove mounting portion is a hook-and-loop fastener.

4. The baseball training apparatus of claim 1, wherein the bat mounting portion and the glove mounting portion are integrally formed of a single member.

5. The baseball training apparatus of claim 1, wherein the bat mounting portion and the glove mounting portion are separate members attached together.

6. A baseball training apparatus for securely mounting a baseball glove on a baseball bat, said apparatus comprising:

a single elongated, flexible, mounting strap having first and second opposite, free ends, and a fastener at each of the first and second ends that releasable connects the first and second ends to form an adjustable loop such that said mounting strap is wrappable around a barrel of the baseball bat;

at least one transverse elongated, flexible connector strap extending outwardly from opposite edges of the mounting strap and being disposed perpendicular to said mounting strap, each said connector strap having first and second opposite, free ends, and a fastener at each of the first and second ends that releasably connects the first and second ends to form an adjustable loop such that said connector strap is wrappable around a rear portion of the baseball glove and a pocket of the baseball glove faces away from the baseball bat.

7. The baseball training apparatus of claim 6, including two connector straps.

8. The baseball training apparatus of claim 7, wherein the connector straps are generally equidistant from a center of the mounting strap.

9. The baseball training apparatus of claim 6, wherein:

the fastener of the mounting strap is a hook-and-loop fastener disposed on, opposite first and second sides, the mounting strap first side including loops of the hook-and-loop fastener and the mounting strap second side including hooks of the hook-and-loop fastener; and the fastener of each connector strap is a hook-and-loop fastener, each connector strap having opposite first and second sides, the connector strap first side including loops of the hook-and-loop fastener and the connector strap second side including hooks of the hook-and-loop fastener.

10. The baseball training apparatus of claim 9, wherein the mounting strap first side faces the same direction as each connector strap first side, and the mounting strap second side faces the same direction as each connector strap second side.

11. The baseball training apparatus of claim 6, wherein each connector strap is disposed generally perpendicular to the main strap.

12. The baseball training apparatus of claim 6, wherein each connector strap extends across the mounting strap.

13. The baseball training apparatus of claim 6, wherein each connector strap is shorter than the mounting strap.

14. The baseball training apparatus of claim 6, wherein each connector strap is smaller than the mounting strap.

15. The baseball training apparatus of claim 6, wherein the mounting strap and each connector strap are portions of an integrally formed single member.

16. The baseball training apparatus of claim 6, wherein the mounting strap and each connector strap are separate members attached together.

17. A baseball training apparatus in combination with a baseball bat and a baseball glove, comprising:

a baseball bat including a handle end and a barrel extending from said handle end;

a baseball glove including a pocket and a wrist strap;

a baseball training apparatus including:

a single elongated, flexible, mounting strap having first and second opposite, free ends, and a fastener at each of said first and second ends that releasably connects said first and second ends to form an adjustable loop; and two transverse elongated, flexible spacedly disposed connector straps separately attached perpendicularly to said mounting strap and extending from opposite edges of said mounting strap such that said connector straps are generally equidistant from a center of said mounting strap, each said connector strap having first and second opposite, free ends, and a fastener at each of said first and second ends that releasably connects said first and second ends to form an adjustable loop;

said mounting strap circumscribing said barrel of said baseball bat to attach said apparatus to said baseball bat;

said handle end of said baseball bat being inserted through said wrist strap of said baseball glove and said pocket of said baseball glove facing away from said barrel of said baseball bat;

said connector straps circumscribing said wrist strap of said baseball glove to attach said apparatus to said baseball glove;

wherein said baseball glove is secured to said baseball bat.

* * * * *